US006836731B1

(12) United States Patent
Whalley et al.

(10) Patent No.: US 6,836,731 B1
(45) Date of Patent: Dec. 28, 2004

(54) METHOD AND SYSTEM OF DETERMINING WELL PERFORMANCE

(75) Inventors: Robert Whalley, Headley (GB); Lino Lopes Cancado, Estado Zulia (VE); Luis Sandoval, Caracas (VE); Jesus Prato, Estado Monagas (VE)

(73) Assignee: Schlumberger Technology Corporation, Sugar Land, TX (US)

( * ) Notice: Subject to any disclaimer, the term of this patent is extended or adjusted under 35 U.S.C. 154(b) by 16 days.

(21) Appl. No.: 10/068,321

(22) Filed: Feb. 5, 2002

Related U.S. Application Data

(60) Provisional application No. 60/267,083, filed on Feb. 5, 2001.

(51) Int. Cl.[7] ..... G06F 19/00
(52) U.S. Cl. ..... 702/13
(58) Field of Search ..... 702/12, 13; 367/73; 703/10

(56) References Cited

U.S. PATENT DOCUMENTS 5,992,519 A * 11/1999 Ramakrishnan et al. ..... 166/250.15
6,002,985 A * 12/1999 Stephenson ..... 702/13
6,012,016 A * 1/2000 Bilden et al. ..... 702/12
6,182,756 B1 * 2/2001 Garcia et al. ..... 166/250.15
6,236,894 B1 * 5/2001 Stoisits et al. ..... 700/28

* cited by examiner

*Primary Examiner*—Donald E. McElheny, Jr.
(74) *Attorney, Agent, or Firm*—Brigitte L. Echols; John J. Ryberg

(57) ABSTRACT

A well optimization index WOI is an indicator for tracking trends and monitoring overall well performance. The WOI is a weighted average of two numbers reflecting operation execution performance (i.e., the Well Operation Time Ratio ($WCT_R$)) and production result performance (i.e., the Productivity Index Ratio ($PI_R$)). The WOI is calculated by a spreadsheet program used in a data-processing system. The spreadsheet program automatically generates the WOI for the well according to the expression:

$$WOI = \frac{PI_R N + WCT_R}{N+1};$$

wherein N is a weighting constant which represents a recovery of cost, that is estimated based on historical data. The WOI index varies from zero (worst case) to one (best case), and is used to indicate where operations may need additional attention to meet the level of performance desired (i.e., WOI as close to one as possible).

56 Claims, 2 Drawing Sheets

| | A | B | C | D |
|---|---|---|---|---|
| 1 | WELL NAME | $WCT_R$ | $PI_R$ | WOI |
| 2 | | | | |
| 3 | | | | |
| 4 | | | | |

METHOD AND SYSTEM OF DETERMINING WELL PERFORMANCE

The present invention claims the benefit of priority under 35 U.S.C. §119(e) from U.S. Provisional Application No. 60/267,083, filed Feb. 5, 2001, the contents of which are herein incorporated by reference.

BACKGROUND OF THE INVENTION

1. Field of the Invention

The present invention relates to a method and system of determining overall well performance by the calculation of a well optimization index derived from a relation between well operation execution performance and the productivity of the well.

2. Description of the Related Art

In conventional systems, there is no single parameter in common use that allows operations groups to systematically assess the degree of success to which a well has been drilled or intervened.

Most parameters used today relate only to the particular area they are in, or are related to an Authorization for Expense (AFE) or plan generated by the executors themselves. Typically in oil companies today, a successful well is when the AFE targets for cost and time are achieved underbudget, or when these time or cost targets are improvements in the area of activity. Similarly for production targets, when historical rates are exceeded the well is considered a success. Clearly without comparisons to absolute or potential values, the true success or optimization of a well can not be concluded, and neither can any systematic cross-area comparisons be made.

Well optimization has two fundamental elements, well cost (or time), and well productivity. Typically parameters that express the performance in these two areas are kept separate, and as a consequence, it is not uncommon that very successful drilling performance is not mirrored in well productivity, or vice versa. At a minimum, it is commonly seen that the timing and degree of effort applied to each area is poorly synchronized.

Further, since in most projects, fundamental inputs to determine well optimization are not immediately available, and would require a significant effort to generate, achieving an understanding of optimum well times and production potential such that well optimization can be easily determined with a particular degree of accuracy, is necessary.

SUMMARY OF THE INVENTION

Methods and systems consistent with the present invention include the calculation of a common indicator for tracking trends and monitoring overall well performance—known as a well optimization index (WOI).

The WOI is calculated as a weighted average of two numbers reflecting operation execution performance (i.e., the Well Construction Operation Time Ratio ($WCT_R$)) and production result performance (i.e., the Productivity Index Ratio ($PI_R$)). The WOI is general for all kinds of well operations (i.e., oil or gas wells), such as drilling new wells or re-entering old wells, completions, workovers or rig-less work (i.e., stimulation, coiled tubing (CT), etc.).

The two indices $WCT_R$ and $PI_R$ each represent the performance of the well operation performed as compared to an optimum value. The $WCT_R$ can be calculated immediately after the well operation is completed, but the productivity index ratio $PI_R$ can only be calculated after the well production initiates and stabilizes. Because of this reason, the WOI index might not be available until a certain amount of data on the well operation is received.

Since production is typically of more ultimate value than the amount of cost that can be saved by reducing drilling or intervention times, the $PI_R$ term is weighted. Currently the proposed weighting is based upon "average" global production values versus "average" global well costs. The weighting is expressed as a constant, which represents recovery of cost.

In one embodiment, consistent with the present invention, the method of determining the WOI is carried out in a spreadsheet program used in a data-processing system, the program performing the method including the steps of generating a well construction time ratio $WCT_R$ for the well; generating a well productivity index ratio $PI_R$ for the well; and automatically generating a well optimization index WOI for the well based on a relation between the well construction time ratio $WCT_R$ and the well productivity index ratio $PI_R$.

Specifically, in one embodiment consistent with the present invention, the WOI generating step includes automatically comparing a weighted average of an operation execution performance as defined by the well construction time ratio $WCT_R$, to the production result performance as defined by the well productivity index ratio $PI_R$, according to the following expression:

$$WOI = \frac{PI_R N + WCT_R}{N+1};$$

wherein N is a weighting constant which represents a recovery of cost of a well operation, that is estimated based on historical data. In another embodiment consistent with the present invention, the WOI comparing step includes the step of inputting the weighting constant N from either an external source or a memory storage device.

In another embodiment consistent with the present invention, the WOI generation step includes the step of receiving a name of the well from an external source prior to the well construction time ratio $WCT_R$ generating step. The well construction time ratio $WCT_R$ generating step includes the step of automatically comparing a well construction theoretical limit $WCT_L$, defined as a theoretical minimum rig time to execute a well operation, in days, to an actual well construction time $WCT_L$, in days, in accordance with the following expression:

$$WCT_R = \frac{WCT_L}{WCT_A}.$$

In one embodiment consistent with the present invention, the well construction time ratio $WCT_R$ varies from 1.0 in a best case where intervention time equals said predetermined technical limit $WCT_L$, to zero in a worst case, where intervention would not be completed.

In a further embodiment consistent with the present invention, the well construction theoretical limit $WCT_L$ is a predetermined technical limit for each well type, and the well construction theoretical limit $WCT_L$ is either retrieved from the memory storage device or received from an external source.

In another embodiment consistent with the present invention, the well construction theoretical limit $WCT_L$ is an addition of actual best time of historical data for each phase for each well type, minus fifteen percent, and the well construction theoretical limit $WCT_L$ is either retrieved from a memory storage device or received from an external source.

In a further embodiment consistent with the present invention, the $WCT_R$ comparing step includes the step of receiving the actual well construction time $WCT_A$ from either the external source or the memory storage device.

In another embodiment consistent with the present invention, when a different rig is used to complete the well, the well construction theoretical limit $WCT_L$ and the actual well construction time $WCT_A$ are each calculated by adding drilling rig days plus completion rig days for the well, and the calculated well construction theoretical limit $WCT_L$ and the calculated actual well construction time $WCT_A$ are received from either the external source or the memory storage device.

In another embodiment consistent with the present invention, when the technical limit $WCT_L$ is not available, then the well construction time ratio $WCT_R$ is replaced by an operation cost ratio $OC_R$, as defined by the following expression:

$$OC_R = \frac{OC_{AFE}}{OC_A}$$

wherein:

$OC_{AFE}$=Operational Cost as given by an Authorization For Expense $OC_A$=Actual Operation Cost; and wherein when the $OC_{AFE}$ and the $OC_A$ are either retrieved from the memory storage or received from an external source, the $OC_R$ is automatically generated.

In another embodiment consistent with the present invention, the well productivity index ratio $PI_R$ generating step includes the step of automatically comparing an optimum productivity index $PI_O$, in BFPD/psi (or BFPD/psi/foot of perforated interval), to an actual productivity index $PI_A$, in BFPD/psi, in accordance with the following expression:

$$PI_R = PI_A / PI_O.$$

In another embodiment consistent with the present invention, the well productivity index ratio $PI_R$ varies from 1.0 in a best case where productivity of the well is at an optimum, and zero in a worst case, where the well has no production.

In one embodiment consistent with the present invention, the actual productivity index $PI_A$ is automatically generated in accordance with the following expression:

$$PI_A = \frac{Q_a}{(P_{av} - P_{wf})}$$

wherein:

$Q_a$=Actual flow rate measured at a surface (BFPD)

$P_{av}$=Average reservoir static pressure (psi)

$P_{wf}$=Actual bottom hole flowing pressure (psi); and wherein $Q_a$ and $P_{wf}$ are either received from an external source or retrieved from the memory storage, and $P_{av}$ is either generated based on data inputted from the external source, or retrieved from the memory storage.

In one embodiment consistent with the present invention, the optimum productivity index $PI_O$ is a predetermined number generated using at least one of Darcy Law and Vogel inflow equations depending on conditions of a reservoir from which the well will produce, and the optimum productivity index $PI_O$ is either retrieved from a memory storage device or received from an external source.

In one embodiment consistent with the present invention, the optimum productivity index generating step includes the step of receiving data on an average reservoir static pressure $P_{av}$ and on a bubble point pressure $P_b$, and when the average reservoir static pressure $P_{av}$ is more than the bubble point pressure $P_b$, the optimum productivity index $PI_O$ is automatically generated using Darcy Law according to the following expression:

$$PI_O = \frac{Q_0}{(P_{av} - P_{wf})} = \frac{7.08Kh}{\mu B_0 \ln(R_e / R_w - 0.5)}$$

wherein:

K=Formation permeability in Darcies

H=Formation thickness, in ft.

$P_{av}$=Average reservoir pressure, in psi $P_{wf}$=Bottom hole flowing pressure, in psi $\mu$=Viscosity, in Cp $R_e$=Outer radius of well influence, ft.

$R_w$=Wellbore radius, ft.

$B_0$=Formation volume factor or volumetric factor $Q_0$=Flow rate (BFPD), at sand face and with no skin (S=0); and wherein K, H, $P_{av}$, $P_{wf}$, $\mu$, $R_e$, $R_w$, $B_0$, and $Q_0$, are one of received from said external source and retrieved from said memory storage.

In another embodiment consistent with the present invention, the optimum productivity index generating step includes the step of receiving data on an average reservoir static pressure $P_{av}$ and on a bubble point pressure $P_b$, and when the average reservoir static pressure $P_{av}$ is less than the bubble point pressure $P_b$, the optimum productivity index $PI_O$ is automatically generated using Vogel's equation according to the following expression:

$$PI_O = \frac{Q_{max}}{(P_{av} - P_{wf})};$$

wherein:

$P_{av}$=Average reservoir static pressure, in psi $P_{wf}$=Actual bottom hole flowing pressure, in psi $Q_{max}$=Maximum flow rate liberality (BFPD); and wherein $Q_{max}$ is automatically generated according to the expression:

$$\frac{Q_a}{Q_{max}} = 1 - 0.2\frac{(P_{wf})}{(P_{av})} - 0.8\frac{\{(P_{wf})\}^2}{\{(P_{av})\}}$$

wherein:

$Q_a$=Actual flow rate measured at surface (BFPD)

$P_{av}$=Average reservoir static pressure (psi)

$P_{wf}$=Actual bottom hole flowing pressure (psi); and wherein $Q_a$ and $P_{wf}$ are either received from an external source or retrieved from a memory storage, and $P_{av}$ is either generated based on data inputted from the external source or retrieved from the memory storage.

In another embodiment consistent with the present invention, the optimum productivity index generating step includes the step of receiving data on an average reservoir static pressure $P_{av}$, an actual bottom hole flowing pressure $P_{wf}$, and on a bubble point pressure $P_b$, and when the actual bottom hole flowing pressure $P_{wf}$ is less than a bubble point pressure $P_b$, and the bubble point pressure $P_b$ is less than the average reservoir static pressure $P_{av}$, then the optimum productivity index $PI_O$ is automatically generated using a Darcy Law modified equation defined according to the following expression:

$$PI_O = \frac{Q_0}{(P_{av} - P_{wf})} = \frac{7.08Kh}{\mu B_0 \ln(R_e / R_w - (0.75 + S))}$$

wherein:

K=Formation permeability in Darcies

H=Formation thickness, in ft.

$P_{av}$=Average Reservoir Pressure, in psi $P_{wf}$=Bottom Hole flowing Pressure, in psi $\mu$=Viscosity, in Cp $R_e$=Outer radius of well influence, ft.

$R_w$=Wellbore radius, ft.

$Q_0$=Flow rate (BFPD), at sand face and with no Skin (S=0)

$B_0$=Formation volume factor or volumetric factor

S=Skin factor wherein K, H, $P_{av}$, $P_{wf}$, $\mu$, $R_e$, $R_w$, $B_0$, S, and $Q_0$, are either received from an external source and retrieved from a memory storage.

In another embodiment consistent with the present invention, when the well was producing before an operation is performed, the well productivity index ratio $PI_R$ is automatically generated as an increment to a productivity index obtained with the operation, as defined by the following expression:

$$PI_R = (PI_A - PI_{BO})/PI_{BO}$$

wherein:

$PI_A$=Actual Productivity Index (BFPD/psi)

$PI_{BO}$=Productivity Index Before the Operation (BFPD/psi); and wherein the productivity index $PI_{BO}$ is automatically generated for conditions that exist before a well operation, according to the following expression:

$$PI_{BO} = \frac{Q_a}{(P_{av} - P_{wf})}.$$

In another embodiment consisting with the present invention, a computer-readable medium contains instructions that cause a data processing system having a spreadsheet program to perform a method of determining performance of a well, the method performed by the spreadsheet program including the steps of generating a well construction time ratio $WCT_R$ for the well; generating a well productivity index ratio $PI_R$ for the well; and automatically generating a well optimization index WOI for the well based on a relation between the well construction time ratio and the well productivity index ratio.

In another embodiment consistent with the present invention, a data processing system includes a memory having a spreadsheet program that generates a well construction time ratio $WCT_R$ for a well, that generates a well productivity index ratio $PI_R$ for the well, and that automatically generates a well optimization index WOI for the well based on a relation between the well construction time ratio and the well productivity index ratio to determine performance of the well; and a processor that runs the program.

In another embodiment consistent with the present invention, there exists a method in a data-processing system for determining performance of a well, the data processing system having a spreadsheet program which performs a method comprising the steps of receiving a name of the well from an external source; retrieving first data about the well from a memory storage device based on the name of the well; receiving second data about the well from the external source; generating a well construction time ratio $WCT_R$ for the well using the first data and the second data; generating a well productivity index ratio $PI_R$ for the well using the first data and the second data; and automatically generating a well optimization index WOI for the well based on a relation between the well construction time ratio and the well productivity index ratio.

In another embodiment consistent with the present invention, there exists a method in a data-processing system for determining performance of a well, the data processing system having a spreadsheet program which performs a method comprising the steps of receiving a name of the well from an external source; receiving a request to generate a well construction time ratio $WCT_R$ for the well; retrieving well construction time technical limit $WCT_L$ data on the well from a memory storage device based on the name of the well; receiving actual well construction time data $WCT_A$ on the well from an external source; automatically generating a dwell construction time ratio $WCT_R$ based on a relation between the well construction time technical limit $WCT_L$ and an actual well construction time $WCT_A$; receiving a request to generate a well productivity index ratio $PI_R$ for the well; receiving actual productivity data on the well; generating an actual productivity index $PI_A$ based on the actual productivity data; generating an optimum productivity index $PI_O$ based on said actual productivity data and stored productivity data based on said name of the well, retrieved from the memory storage device; automatically generating the well productivity index ratio $PI_R$ based on a relation between the actual productivity index $PI_A$ and the optimum productivity index $PI_O$; and automatically generating a well optimization index WOI for the well based on a relation between the well construction time ratio $WCT_R$ and the well productivity index ratio $PI_R$.

In another embodiment consistent with the present invention, there exists a method of determining performance of a well, the method including the steps of generating performance data from measurements taken du ring operation of the well; generating a well construction time ratio $WCT_R$ for the well using the performance data; generating a well productivity index ratio $PI_R$ for the well using the performance data; and automatically generating a well optimization index WOI for the well based on a relation between the well construction time ratio and the well productivity index ratio.

In another embodiment consistent with the present invention, the method is performed by a data processing system.

The WOI varies from 0% (worst) to 100% (best), and can be easily used to indicate where operations may need additional attention to meet the level of performance desired (i.e., WOI as close to 100% as possible). The WOI also can be used as an indicator of the project performance trends over project time.

There has thus been outlined, rather broadly, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

DETAILED DESCRIPTION OF THE PREFERRED EMBODIMENTS

Methods and systems consistent with the present invention include determining well performance by the calculation of a common indicator known as a well optimization index (WOI).

Figures 1, 2:
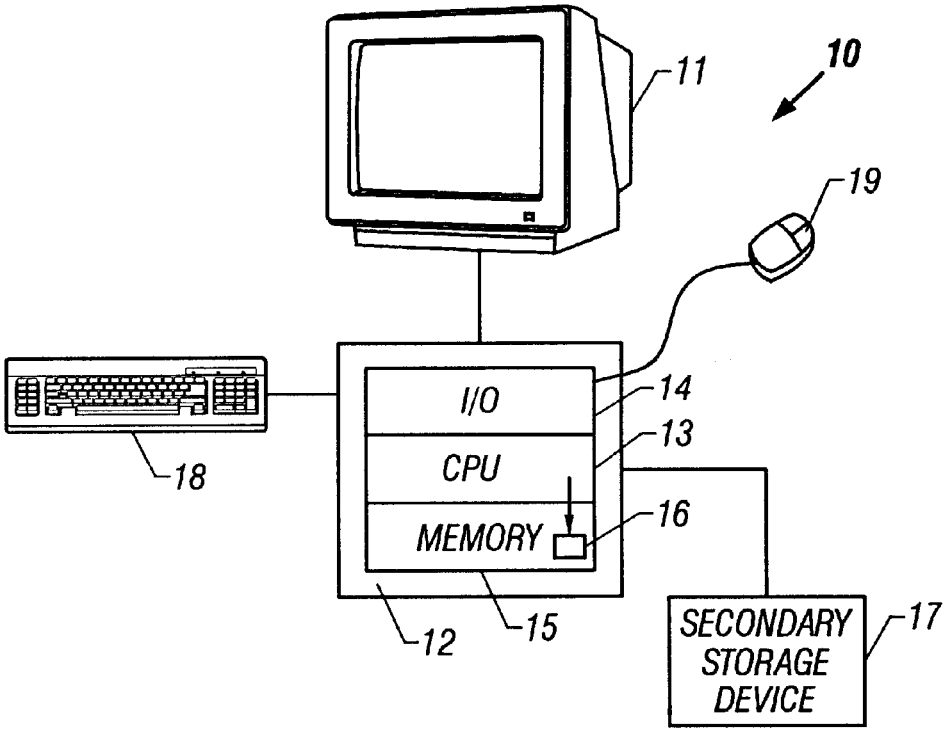
FIG. 1 depicts a data processing system suitable for practicing methods and system consistent with the present invention.
FIG. 2 depicts a spreadsheet used with the system of FIG. 1.

An embodiment consistent with the present invention is described with reference to FIG. 1. FIG. 1 depicts a data processing system which utilizes a spreadsheet program for calculation of the WOI. The data processing system 10 may include a display 11, system chassis housing 12, a central processing unit (CPU) 13, an input/output (I/O) unit 14, a memory 15 with program 16, and may also include a secondary storage device 17. The program 16 is run from memory 15 in the data processing system 10, as shown in FIG. 1, and as described below. The data processing system 10 or computer system 10 may further include standard input devices like a keyboard 18, a mouse 19, or a speech processing means (not shown).

Although aspects of one implementation are depicted as being stored in memory 15, one skilled in the art will appreciate that all or part of systems and methods consistent with the present invention may be stored on or read from other computer-readable media, such as secondary storage devices 17, like hard disks, floppy disks, and CD-ROM; a carrier wave received from a network such as the Internet; or other forms of ROM or RAM either currently known or later devleoped. Further although specific components of the data processing system have been described, one skilled in the art will appreciate that a data processing system suitable for use with methods and systems consistent with the present invention may contain additional or different components.

One skilled in the art will also appreciate that methods, systems, and articles of manufacture consistent with the present invention, may also be implemented in a client-server environment. The client computer system 10 and server computer system (not shown) are each connected to a network, such as a Local Area Network, Wide Area Network, or the Internet. The spreadsheet may be displayed on a display screen 11 of the client device 10 while some of all steps of the method and system consistent with the present invention, are carried out on the server component system accessible by the client computer system 10 over, for example, the Internet, using browser application or the like.

A spreadsheet program 16 (hereafter "the program") is run on the data processing system 10, and the program carries out the automatically determination of the WOI when data is inputted into the spreadsheet from a user. The format of the WOI spreadsheet is simple and, in one embodiment consistent with the present invention, has four columns, although more columns may be added for showing various data entries etc. The first column (A) is provided for the well name, the second column (B) is provided for a well construction time ratio ($WCT_R$), the third column (C) is provided for a productivity index ratio ($PI_R$), and the last column (D) is provided for the WOI value.

Figure 3:
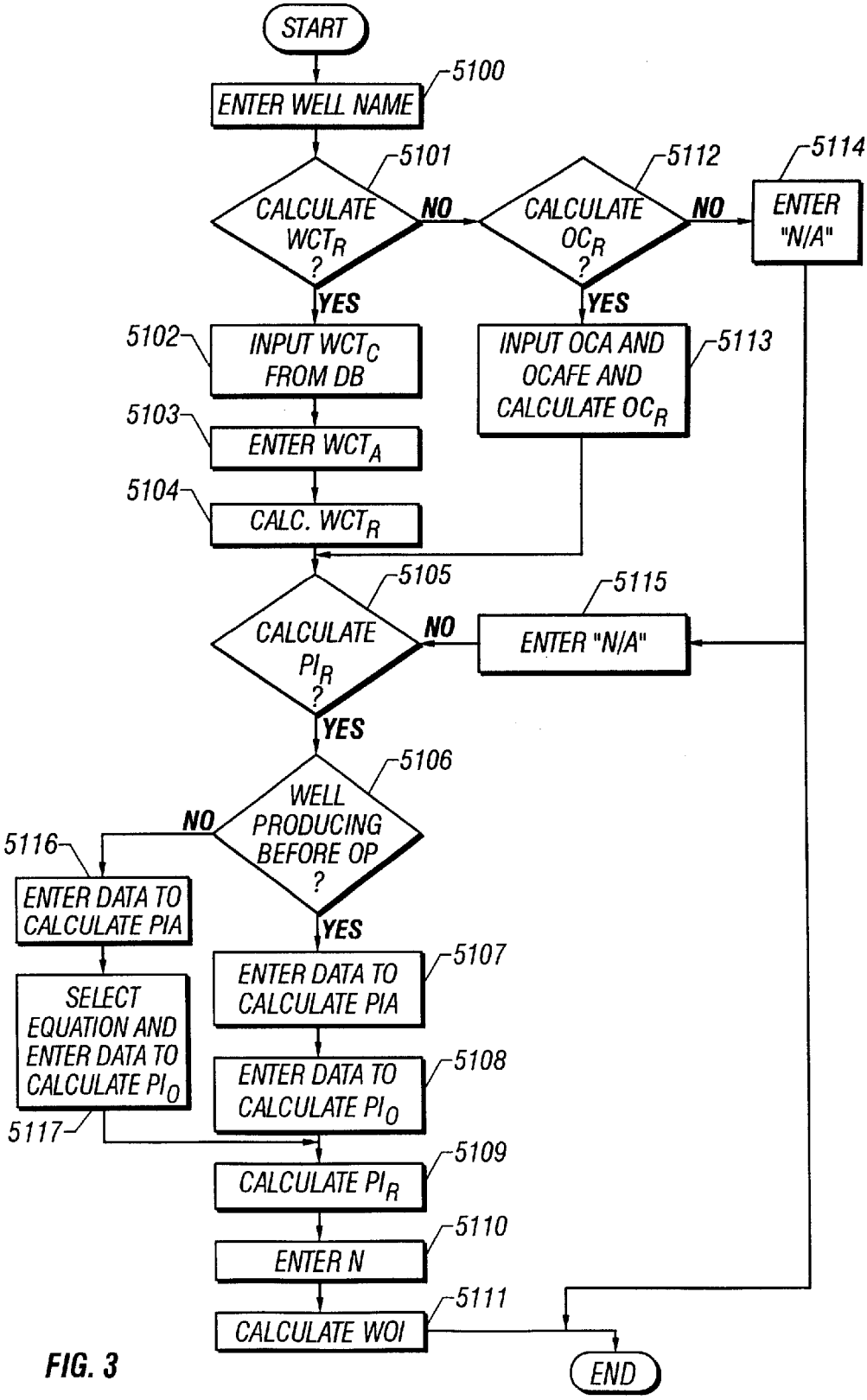
FIG. 3 depicts a flowchart outlining the major steps in the method and system of FIG. 1.

Specifically, in one embodiment consistent with the present invention, the spreadsheet program begins the determination of the WOI by asking for the well name. The user enters the well name into the spreadsheet program under column A in step S100 (see FIG. 3 for the flowchart). The program receives the data entry of the well name and automatically requests the user in step S101 as to whether the user wishes to proceed with the calculation of the well construction time ratio ($WCT_R$).

If the answer is no, the program proceeds to step S112, and asks whether the user wishes to determine the operational cost ratio $OC_R$ as an alternate to the $WCT_R$. If the answer is no, the program enters a "not applicable" or "N/A" into columns B, C, and D of the spreadsheet, and the program ends. Thus, while the values to calculate the $WCT_R$ and $PI_R$ and, thus, the WOI, are not available, these three columns should contain "N/A" until well production is initiated and the data can be updated.

However, if the answer is yes, then the program proceeds to calculate the $OC_R$ in step S113. The calculation of the $OC_R$ is discussed in further detail below.

However, if the answer in step S1101 is yes, and the user wishes to calculate the $WCT_R$, then the program proceeds to provide information on the well which was received by the program in step S100.

Essentially, in step S102, the program provides data from memory 15, or from secondary storage device 17, or from another source, or data which is even inputted by the user, on a well construction theoretical limit ($WCT_L$) based on the designated well. The $WCT_L$ is defined as the minimum rig time it would take to execute a well operation using the best available resource and technology, applying best practices and with optimum rig and working conditions. The same concept applies for all well intervention operations (drilling and completion, workovers, well servicing and others). In the event that a different rig is used to complete the well, then, the $WCT_L$ is the total of adding up drilling rig days plus completion rig days for that particular well.

In order to come up with the $WCT_L$, a "Technical Limit" workshop should be held for each well type. This workshop involves those of skill in the art who are involved in the particular wells, determining various technical data for each of the wells with respect to the optimum values which can be attained. If no workshop has been held, the $WCT_L$ will be taken as the addition of the best time of the historical data for the field for each phase ("best composite") of the well type drilled completed or worked over, less fifteen percent. This data can be inputted into memory.

The program then prompts the user in step S103, to enter the actual well construction time ($WCT_A$), which is defined as the real time it took for the current well operation. The time starts with the closing in report on the previous well and ends with the closing in report on the current well.

In the event that a different rig is used to complete the well, $WCT_A$ is the total of adding up drilling rig days plus completion rig days.

Again, as with all data required by the spreadsheet program to calculate the WOI, the $WCT_A$ data can be inputted by the user, or retrieved from memory or other source.

Once the program receives the $WCT_L$ and the $WCT_A$, the program automatically calculates the $WCT_R$ in step S104 in accordance with the equation (1) below:

$$WCT_R = WCT_L / WCT_A \tag{1}$$

wherein:

$WCT_L$=Well Construction Time–Technical Limit, in days $WCT_A$=Actual Well Construction Time, in days Note that the value of $WCT_A$ will only vary from the $WCT_L$ (best case scenario, where the intervention time is equal to the technical limit) to infinite (worst case scenario, intervention would take forever), and that $WCT_R$ will vary from 1 (best) to 0 (worst) respectively. If a well operation is executed in a time $WCT_A$ which is less than $WCT_L$, than $WCT_L$ will become automatically equal to $WCT_A$ (new technical limit has been set) and $WCT_R$ will be 1. This is expressed by the condition (a) below.

$$\{WCT_A = WCT_L \sim\infty \Rightarrow \quad WCT_R = 1 \sim 0$$

$$\{\text{If: } WCT_A = WCT_A{}^* < WCT_L \rightarrow WCT_L = WCT_A{}^* \tag{a}$$

Once $WCT_R$ is entered into column B by the program, the program proceeds to step S105 and the calculation of the productivity index ratio $PI_R$ of column C.

However, in the event that the user indicated in step S101 that the $WCT_R$ was not to be determined, the program proceeds to step S112 in the following manner.

For example, in operations where a technical time limit cannot be established (rig-less stimulation, CT intervention, rod pump replacement, etc.) then the $WCT_R$ should be replaced by an operation cost ratio $OC_R$, which is defined by equation (2) below. Note the same concepts and definitions used on the $WCT_R$ also apply to the operation cost ratio ($OC_R$).

Thus, the program asks in step S112 whether the $OC_R$ is to be determined. If the answer is yes, the user is requested to enter the operational cost as given by the AFE ($OC_{AFE}$), and the actual operation cost ($OC_A$). However, this data can also be retrieved from memory 15 or a secondary storage device 17 etc.

The program then automatically calculates the $OC_R$ in S113 according to equation (2).

$$OC_R = \frac{OC_{AFE}}{OC_A} \tag{2}$$

wherein:

$OC_{AFE}$=Operational Cost as given by the AFE $OC_A$=Actual Operation Cost

The $OC_R$ is entered by the program into column B of the spreadsheet document, as would have been the $WCT_R$.

The program then continues with the calculation of the $PI_R$ for column C. Thus, the program asks in step S105 whether the $PI_R$ should be calculated. If the answer is no, then the program proceeds to steps S115 and enters "N/A" in columns C and D for the $PI_R$ and WOI, respectively, as described in step S114, and the program ends.

However, if the answer is yes in step S105, and the $PI_R$ is to be determined, the program proceeds to step S106 and asks if the well for which the WOI is being determined, was producing before the particular well operation. If the answer is no, then the program proceeds to step S116 and the user is requested to enter data for the determination of the actual productivity index $PI_A$.

The $PI_A$ is calculated using equation (3) below, by entering field measurements of $P_{wf}$ and $Q_a$ after the well is put on production and is stabilized.

$$PI_A = \frac{Q_A}{(P_{av} - P_{wf})} \tag{3}$$

$Q_a$=Actual flow rate measured at Surface (BFPD)

$P_{av}$=Average reservoir static pressure (psi)

$P_{wf}$=Actual bottom hole flowing pressure (psi)

Thus, the program requests in step S116, for data $Q_a$, $P_{av}$, and $P_{wf}$, which are then entered by the user. The $P_{av}$ may also be generated by the program by entering the reservoir static pressure at different points to determine the average. The data $Q_a$, $P_{av}$, and $P_{wf}$, may also be retrieved from memory 15 or 17, or inputted from another source etc.

The other value that needs to be determined to calculate the $PI_R$ value is the optimum productivity index ($PI_O$) of the well. This has to be done using inflow equations, like Darcy or Vogel, depending on the conditions of the reservoir from which the well will produce.

Therefore, in step S117, the program asks for the bubble point pressure $P_b$, which is defined as the pressure above which only liquid (oil) is present, and below which gas and liquid (two-phase) coexist. The program then determines whether the bottom hole flowing pressure of the well ($P_{wf}$) is above or below the bubble point pressure ($P_b$), since this is what determines which equation is to be used to calculate the $PI_O$. The selection of the equation to calculate the $PI_O$ depends on three conditions described below, and is determined by the program based on the data entered.

(I) If $P_{av} > P_b$, then Darcy Law is applicable.

(II) If $P_{av} < P_b$, then Vogel equation is applicable.

(III) If $P_{wf} < P_b < P_{av}$, then a Darcy modified equation is applicable.

Thus, the program automatically determines which of equations (I)–(III) are used based on the data entered.

For case (I) above, $PI_O$ is calculated as defined in equation (4) below:

$$PI_O = \frac{Q_0}{(P_{av} - P_{wf})} = \frac{7.08Kh}{\mu B_0 \ln(R_e / R_w - 0.5)} \tag{4}$$

wherein:

K=Formation permeability in Darcies

H=Formation thickness, in ft.

$P_{av}$=Average Reservoir Pressure, in psi $P_{wf}$=Bottom Hole flowing Pressure, in psi $\mu$=Viscosity, in Cp $R_e$=Outer radius of well influence, ft.

$R_w$=Wellbore radius, ft.

$Q_0$=Flow rate (BFPD), at sand face and with no Skin (S=0)

$B_0$=Formation volume factor or volumetric factor

Thus, the program will request input of the above data, such as K, H, etc., in step S117, the data may be retrieved from memory 15 or 17, or inputted from another source etc.

For case (II) above, $PI_O$ is calculated by the program as defined by equations (5) & (6) below.

In this instance, when the program determines that the reservoir average pressure $P_{av}$ is below the bubble point $P_b$, the program will then determine the maximum flow rate from the well $Q_{max}$. Upon input of the average reservoir pressure $P_{av}$ the bottomhole flowing pressure $P_{wf}$, as well as the actual flow rate measured at the surface $Q_a$, the program determines $Q_{max}$ according to the following equation:

$$\frac{Q_a}{Q_{\max}} = 1 - 0.2\frac{\{P_{wf}\}}{\{P_{av}\}} - 0.8\frac{\{P_{wf}\}^2}{\{P_{av}\}} \quad (5)$$

wherein:

$Q_a$=Actual flow rate measured at surface (BFPD)

$Q_{max}$=Maximum flow rate liberality (BFPD)

$P_{av}$=Average reservoir static pressure (psi)

$P_{wf}$=Bottom Hole flowing Pressure, in psi

Once the program determines the value of $Q_{max}$ according to equation (5), the program then automatically determines the $PI_O$ as given by equation (6) below:

$$PI_O = \frac{Q_{\max}}{(P_{av} - P_{wf})} \quad (6)$$

For case (III) above, $PI_O$ is calculated as defined in equation (7) below:

$$PI_O = \frac{Q_o}{(P_{av} - P_{wf})} = \frac{7.08Kh}{\mu B_0 \ln(R_e / R_w - (0.75 + S))} \quad (7)$$

wherein:

K=Formation permeability in Darcies

H=Formation thickness, in ft.

$P_{av}$=Average Reservoir Pressure, in psi $P_{wf}$=Bottom Hole flowing Pressure, in psi $\mu$=Viscosity, in Cp $R_e$=Outer radius of well influence, ft.

$R_w$=Wellbore radius, ft.

$Q_0$=Flow rate (BFPD), at sand face and with no Skin (S=0)

$B_0$=Formation volume factor or volumetric factor

S=Skin factor

As above, the program will request input of the above data, such as K, H, etc., in step S117, or the data may be retrieved from memory 15 or 17, or inputted from another source etc.

Once $PI_A$ and $PI_O$ are determined, then in step S109, the program can automatically determine the well productivity index ratio $PI_R$, which is defined as the division of the actual well productivity index $PI_A$ by the optimum well productivity index $PI_O$, which is the well productivity index at the sand face with no formation damage. The productivity index ratio $PI_R$ is automatically calculated by the program in step S109 according to the equation (8) below, and entered into the spreadsheet document at column C:

$$PI_R = PI_A / PI_O \quad (8)$$

wherein:

$PI_R$=Productivity Index Ratio $PI_A$=Actual Productivity Index (BPD/psi)

$PI_O$=Optimum Productivity Index

However, if in step S106, when the program asks if the well for which the WOI is being determined was producing before the particular well operation (i.e., workover on active wells or intervention on producing wells like CT, or snubbing, or others), and the answer is yes, then the program proceeds to step S107, and the user is requested to enter data for the determination of the actual productivity index $PI_A$, and the productivity index before the operation $PI_{BO}$ according to equation (9) below. The program will calculate the $PI_A$ according to the same way expressed by equation (3) above, and the $PI_{BO}$ is also calculated by the program the same way using equation (3) above, but with the conditions that exist before the operation.

In this case, the $PI_R$ is defined as the increment to the productivity index obtained with the operation.

$$PI_R = (PI_A - PI_{BO}) / PI_{BO} \quad (9)$$

wherein:

$PI_R$: Productivity Index Ratio $PI_A$: Actual Productivity Index (BPD/psi)

$PI_{BO}$: Productivity Index Before the Operation (BPD/psi)

The value of $PI_A$ can only vary from 0 (worst case scenario, well with no production) to $PI_O$ (best case scenario, productivity index equal to the optimum), and then $PI_R$ will vary from 0 (worst) to 1 (best) respectively.

If a well operation presents a productivity index $PI_A$ which is higher than $PI_O$, than the program will automatically set the $PI_O$ equal to the $PI_A$ (new optimum PI has been set) and the program will automatically determined the $PI_R$ to be 1. This is expressed by the condition (b) below.

$$\{PI_A \sim PI_O \Rightarrow \quad PI_R = 0 \sim 1$$

$$\{\text{If: } PI_A = PI_A^* > PI_O \Rightarrow \quad PI_O = PI_A^* \quad (b)$$

Once the well construction time ratio $WCT_R$ and the well productivity index ration $PI_R$ are determined, in step S110, the program requests a number be entered for weighting constant "N" by the user. The weighting constant N represents a recovery of cost, that is estimated based on historical. The weighting constant N is used to give the appropriate balance between the value added by a high performance operation (faster, cheaper) and the value added by a better production resulted from the operation. The weighting constant N can also be automatically provided based on information on the type of well operation. (Note: This concept can be used for water injector wells in addition to gas wells.) For instance, the value of N may be set as 10 for the purpose of the calculation of the WOI. In operations where the intention is not to produce hydrocarbons, like drilling surface holes or drilling stratigraphic wells, then N is set as zero, and the WOI will be represented only by the operation performance component.

Once N has been provided in step S110, the program, in step S111, automatically calculates the well optimization index WOI as a weighted average from the $WCT_R$ and $PI_R$ indices related to operation execution performance and outcome (result) production of the operation, respectively. The calculation is performed according to equation (10) below, and the program then enters the WOI into column D of the spreadsheet.

$$WVI = \frac{PI_R N + WCT_R}{N + 1} \quad (10)$$

wherein:

$PI_R$=Productivity Index Ratio $WCT_R$=Well Construction (operation) time ratio N=Weighting constant Finally, since the $WCT_R$ and $PI_R$ will vary only from 0 to 1, it is clear that the WOI will also vary only from 0 to 1, with 0 the worst case scenario and 1 the perfect well operation (or expressed as a percentage). Thus, the WOI can be easily used to indicate where operations may need additional attention to meet the level of performance desired (i.e., WOI as close to 100% as possible), and is an accurate indicator of the project performance trends over project time.

While the invention has been particularly shown with reference to the above embodiments, it will be understood by those skilled in the art that various other changes in the form and details may be made therein without departing from the spirit and the scope of the invention.

What is claimed is:

1. A method in a data-processing system for determining performance of a well, the data processing system having a spreadsheet program, which performs a method comprising the steps of:

generating a well construction time ratio $WCT_R$ for the well, said $WCT_R$ reflecting the execution performance of the well;

generating a well productivity index ratio $PI_R$ for the well said $PI_R$ reflecting the production result of the well; and automatically generating a well optimization index WOI for the well based on a weighted average between said well construction time ratio and said well productivity index ratio.

2. The method according to claim 1, wherein said well optimization index WOI generating step comprises the step of automatically comparing a weighted average of an operation execution performances defined by said well construction time ration $WCT_R$, to production result performance as defined by said well productivity index ratio $PI_R$, according to the following expression:

$$WOI = \frac{PI_R N + WCT_R}{N+1};$$

Wherein N is a weighting constant which represents a recovery of cost.

3. The method according to claim 2, wherein N is estimated based on historical data of cost recovery of a well operation.

4. The method according to claim 3, wherein said WOI comparing step comprises the step of inputting said weighting constant N from one of an external source and a memory storage device.

5. The method according to claim 4, wherein said well optimization index WOI varies from one in a best case to zero in a worst case.

6. The method according to claim 5, further comprising the step of receiving a name of the well from an external source prior to said well construction time ratio $WCT_R$ generating step.

7. The method according to claim 6, wherein said well construction time ratio $WCT_R$ generating step comprises the step of automatically comparing a well construction theoretical limit $WCT_L$, defined as a theoretical minimum rig time to execute a well operation, in days, to an actual well construction time $WCT_L$, in days, in accordance with the following expression:

$$WCT_R = \frac{WCT_L}{WCT_A}.$$

.

8. The method according to claim 7, wherein said well construction time ratio $WCT_R$ varies from 1.0 in best case where intervention time equals said predetermined technical limit $WCT_L$, to zero in a worst case, where intervention would not be completed.

9. The method according to claim 8, wherein said well construction theoretical limit $WCT_L$ is a predetermined technical limit for each well type, and said well construction theoretical limit $WCT_L$ is one of retrieved from said memory storage device and received from said external source.

10. The method according to claim 8, wherein said well construction theoretical limit $WCT_L$ is an addition of actual best time of historical data for each phase for each well type, minus fifteen percent, and said well construction theoretical limit $WCT_L$ is one of retrieved from said memory storage device and received from said external source.

11. The method according to claim 8, wherein said $WCT_R$ comparing step comprises the step of receiving said actual well construction time $WCT_A$ from one of said external source and said memory storage device.

12. The method according to claim 11, wherein when a different rig is used to complete the well, said well construction theoretical limit $WCT_L$ and said actual well construction time $WCT_A$ are each calculated by adding drilling rig days plus completion rig days for the well, and said calculated well construction theoretical limit $WCT_L$ and said calculated actual well construction time $WCT_A$ are received from one of said external source and said memory storage device.

13. The method according to claim 12, wherein when said technical limit $WCT_L$ is not available, then said well construction time ration $WCT_R$ is replaced by an operation cost ration $OC_R$ as defined by the following expression:

$$OC_R = \frac{OC_{AFE}}{OC_A}$$

wherein:

$OC_{AFE}$=Operation Cost as given by an Authorization For Expense $OC_A$=Actual Operation Cost; and Wherein when said $OC_{AFE}$ and said $OC_A$ are one of retrieved from said memory storage and received from an external source, said $OC_R$ is automatically generated.

14. The method according to claim 6, wherein said well productivity index ration $PI_R$ generating step comprises the step of automatically comparing an optimum productivity index $PI_O$ in BFPD/psi, to an actually productivity index $PI_A$, in BFPD/psi, in accordance with the following expression:

$$PI_R = PI_A / PI_O.$$

15. The method according to claim 14, wherein said well productivity index ration $PI_R$ varies from 1.0 in a best case where productivity of the well is at an optimum, and zero in a worst case, where the well has no production.

16. The method according to claim 15, wherein said actual productivity index $PI_A$ is automatically generated in accordance with the following expression:

$$PI_A = \frac{Q_a}{(P_{av} - P_{wf})}$$

wherein:

$Q_a$=Actual flow rate measured at a surface (BFPD)

$P_{av}$=Average reservoir static pressure (psi)

$P_{wf}$=Actual bottom hold flowing pressure (psi); and wherein $Q_a$ and $P_{wf}$ are one of received from said external source and retrieved form said memory storage, and $P_{av}$ is one of generated based on data inputted from said external source, and retrieved from said memory storage.

17. The method according to claim 16, wherein said optimum productivity index $PI_O$ is a predetermined number generated using at least one of Darcy Law and Vogel inflow equations depending on conditions of a reservoir from which the well will produce, and said optimum productivity index $PI_O$ is one of retrieved from a memory storage device and received from said external source.

18. The method according to claim 17, further comprising the step of receiving data on an average reservoir pressure $P_{av}$ and on a bubble point pressure $P_b$, and when said average reservoir static pressure $P_{av}$ is more than said bubble point pressure $P_b$, said optimum productivity index $PI_O$ is automatically generated using Darcy Law according to the following expression:

$$PI_o = \frac{Q_0}{(P_{av} - P_{wf})} = \frac{7.08Kh}{\mu B_0 \text{In}(Rc/Rw - 0.5)}$$

wherein:

K=Formation permeability in Darcies

H=Formation thickness, in ft.

$P_{av}$=Average reservoir pressure, in psi $P_{wf}$=Bottom hole flowing pressure, in psi $\mu$=Viscosity, in Cp $R_e$=Outer radius of well influence, ft.

$R_w$=Wellbore radius, ft.

$B_0$=Formation volume factor or volumetric factor $Q_0$=Flow rate (BFPD), at sand face and with no skin (S=O); and wherein K, H, $P_{av}$, $P_{wf}$, $\mu$, $R_e$, $R_w$, $B_0$ and $Q_0$, are one of received from said external source and retrieved from said memory storage.

19. The method according to claim 17 further comprising the step of receiving data on an average reservoir static pressure $P_{av}$ and on a bubble point pressure $P_b$, and when said average reservoir static pressure $P_{av}$ is less than said bubble point pressure $P_b$, said optimum productivity index PI0 is automatically generated using Vogel's equation according to the following expression:

$$PI_O = \frac{Q\max}{(Pav - Pwf)}$$

wherein:

$P_{av}$=Average reservoir static pressure, in psi $P_{wf}$=Actual bottom hole flowing pressure, in psi $Q_{max}$=Maximum flow rate liberality (BFPD); and wherein $Q_{max}$ is automatically generated according to the expression:

$$\frac{Qa}{Q_{\max}} = 1 - 0.2\frac{(P_{wf})}{(P_{av})} - 0.8\frac{\{(P_{wf})\}^2}{\{(P_{av})\}}$$

wherein:

$Q_a$=Actual flow rate measured at surface (BFPD)

$P_{av}$=Average reservoir static pressure (psi)

$P_{wf}$=Actual bottomhole flowing pressure (psi); and wherein $Q_a$ and $P_{wf}$ are one of received from said external source and retrieved from said memory storage, and $P_{av}$ is one of generated based on data inputted from said external source and retrieved from said memory storage.

20. The method according to claim 17, further comprising the step of receiving data on an average reservoir static pressure $P_{av}$, an actual bottom hole flowing pressure $P_{wf}$ and on a bubble point pressure $P_b$, and when said actual bottom hole flowing pressure Pwf is less than a bubble point pressure Pb, and said bubble point pressure Pb is less than said average reservoir static pressure Pav, then said optimum, productivity index Pi0 is automatically generated using a Darcy Law modified equation defined according to the following equation:

$$PI_o = \frac{Q_0}{(P_{av} - P_{wf})} = \frac{7.08Kh}{\mu B_0 \text{In}(Re/Rw - (0.75 + S))}$$

wherein:

K=Formation permeability in Darcies

H=Formation thickness, in ft.

$P_{av}$=Average reservoir pressure, in psi $P_{wf}$=Bottom hole flowing pressure, in psi $\mu$=Viscosity, in Cp $R_e$=Outer radius of well influence, ft.

$R_w$=Wellbore radius, ft.

$Q_0$=Flow rate (BFPD), at sand face and with no skin (S=0)

$B_0$=Formation volume factor or volumetric factor

Wherein K, H, $P_{av}$, $P_{wf}$, $\mu$, $R_e$, $R_w$, $B_0$, S, and $Q_0$, are one of received from said external source and retrieved from said memory storage.

21. The method according to claim 16, wherein when the well was producing before an operation is performed, said well productivity index ration $PI_R$ is automatically generated as an increment to a productivity index obtained with said operation, as defined by the following expression:

$$PI_R = (PI_A - PI_{BO})/PI_{BO}$$

wherein said productivity index $PI_{BO}$ is automatically generated for conditions that exist before a well operation, according to the following expression:

$$PI_{BO} = \frac{Q_a}{(P_{av} - P_{wf})}.$$

22. A computer-readable medium containing instructions that cause a data processing system having a spreadsheet program to perform a method of determining performance of a well, the method performed by the spreadsheet program comprising the steps of:

generating a well construction time ratio $WCT_R$ for the well said $WCT_R$ reflecting the execution performance of the well;

generating a well productivity index ratio $PI_R$ for the well said $PI_R$ reflecting the production result of the well; and automatically generating a well optimization index WOI for the well based on a weighted average between said well construction time ration and said well productivity index ratio.

23. The computer-readable medium according to claim 22, wherein said well optimization index WOI generating step comprises the step of automatically comparing a weighted average of an operation execution performance as defined by said well construction time ration $WCT_R$, to production result performance as defined by said well productivity index ratio $PI_R$, according to the following expression:

$$WOI = \frac{PI_R N + WCT_R}{N+1}$$

wherein N is a weighting constant which represents a recovery of cost.

24. The computer-readable medium according to claim 23, wherein N is estimated based on historical data of cost recovery of a well operation.

25. The computer-readable medium according to claim 24, wherein said WOI comparing step comprises the step of inputting said weighting constant N from one of an external source and a memory storage device.

26. The computer-readable medium according to claim 25, wherein said well optimization index WOI varies from 1.0 in a best case to zero in a worst case.

27. The computer-readable medium according to claim 26, further comprising the step of receiving a name of the well from an external source prior to said well construction time ratio $WCT_R$ generating step.

28. The computer-readable medium according to claim 27, wherein said well construction time ratio $WCT_R$ generating step comprises the step of automatically comparing a well construction theoretical limit $WCT_L$, defined as a theoretical minimum rig time to execute a well operation, in days, to an actual well construction time $WCT_L$, in days, in accordance with the following expression:

$$WCT_R = \frac{WCT_L}{WCT_A}.$$

29. The computer-readable medium according to claim 28, wherein said well construction time ratio $WCT_R$ varies from 1.0 in best case where intervention time equals said predetermined technical limit $WCT_L$, to zero in a worst case, where intervention would not be completed.

30. The computer-readable medium according to claim 29, wherein said well construction theoretical limit $WCT_L$ is a predetermined technical limit for each well type, and said well construction theoretical limit $WCT_L$ is retrieved from said memory storage device.

31. The computer-readable medium according to claim 29, wherein said well construction theoretical limit $WCT_L$ is an addition of actual best time of historical data for each phase for each well type, minus fifteen percent, and said well construction theoretical limit $WCT_L$ is one of retrieved from said memory storage device and inputted from said external source.

32. The computer-readable medium according to claim 29, wherein said $WCT_R$ comparing step comprises the step of receiving said actual well construction time $WCT_A$ from one of said external source and said memory storage device.

33. The computer-readable medium according to claim 32, wherein when a different rig is used to complete the well, said well construction theoretical limit $WCT_L$ and said actual well construction time $WCT_A$ are each calculated by adding drilling rig days plus completion rig days for the well, and said calculated well construction theoretical limit $WCT_L$ and said calculated actual well construction time $WCT_A$ are received from one of said external source and said memory storage device.

34. The computer-readable medium according to claim 33, wherein when said technical limit $WCT_L$ is not available, then said well construction time ration $WCT_R$ is replaced by an operation cost ration $OC_R$ as defined by the following expression:

$$OC_R = \frac{OC_{AFE}}{OC_A}$$

wherein:

$OC_{AFE}$=Operation Cost as given by an Authorization For Expense $OC_A$=Actual Operation Cost; and wherein when said $OC_{AFE}$ and said $OC_A$ are one of retrieved from said memory storage and received from an external source, said $OC_R$ is automatically generated.

35. The computer-readable medium according to claim 27, wherein said well productivity index ration $PI_R$ generating step comprises the step of automatically comparing an optimum productivity index $PI_O$ in BFPD/psi, to an actually productivity index $PI_A$, in BFPD/psi, in accordance with the following expression:

$$PI_R = PI_A / PI_O.$$

36. The computer-readable medium according to claim 35, wherein said well productivity index ration $PI_R$ varies from 1.0 in a best case where productivity of the well is at an optimum, and zero in a worst case, where the well has no production.

37. The computer-readable medium according to claim 36, wherein said actual productivity index $PI_A$ is automatically generated in accordance with the following expression:

$$PI_A = \frac{Q_a}{(P_{av} - P_{wf})}$$

wherein:

$Q_a$=Actual flow rate measured at a surface (BFPD)

$P_{av}$=Average reservoir static pressure (psi)

$P_{wf}$=Actual bottom hold flowing pressure (psi); and wherein $Q_a$ and $P_{wf}$ are one of received from said external source and retrieved form said memory storage, and $P_{av}$ is one of generated based on data inputted from said external source, and retrieved from said memory storage device.

38. The computer-readable medium according to claim 36, wherein said optimum productivity index $PI_0$ is a predetermined number generated using at least one of Darcy Law and Vogel inflow equations depending on conditions of a reservoir from which the well will produce, and said optimum productivity index $PI_O$ is one of retrieved from a memory storage device and received from said external source.

39. The computer-readable medium according to claim 38, further comprising the step of receiving data on an average reservoir pressure $P_{av}$ and on a bubble point pressure $P_b$, and when said average reservoir static pressure $P_{av}$ is more than said bubble point pressure $P_b$, said optimum productivity index $PI_O$ is automatically generated using Darcy Law according to the following expression:

$$PI_o = \frac{Q_0}{(P_{av} - P_{wf})} = \frac{7.08Kh}{\mu B_0 \mathrm{In}(Re/Rw - 0.5)}$$

wherein:

K=Formation permeability in Darcies

H=Formation thickness, in ft.

$P_{av}$=Average reservoir pressure, in psi $P_{wf}$=Bottom hole flowing pressure, in psi $\mu$=Viscosity, in Cp $R_e$=Outer radius of well influence, ft.

$R_w$=Wellbore radius, ft.

$B_0$=Formation volume factor or volumetric factor $Q_0$=Flow rate (BFPD), at sand face and with no skin (S=0); and wherein K, H, $P_{av}$, $P_{wf}$, $\mu$, $R_e$, $R_w$, $B_0$ and $Q_0$, are one of received from said external source and retrieved from said memory storage device.

40. The computer-readable medium according to claim 38 further comprising the step of receiving data on an average reservoir static pressure $P_{av}$ and on a bubble point pressure $P_b$, and when said average reservoir static pressure $P_{av}$ is less than said bubble point pressure $P_b$, said optimum productivity index $PI_O$ is automatically generated using Vogel's equation according to the following expression:

$$PI_O = \frac{Q\max}{(Pav - Pwf)}$$

wherein:

$P_{av}$=Average reservoir static pressure, in psi $P_{wf}$=Actual bottom hole flowing pressure, in psi $Q_{max}$=Maximum flow rate liberality (BFPD); and wherein $Q_{max}$ is automatically generated according to the expression:

$$\frac{Qa}{Q_{\max}} = 1 - 0.2\frac{(P_{wf})}{(P_{av})} - 0.8\frac{\{(P_{wf})\}^2}{\{(P_{av})\}}$$

wherein:

$Q_a$=Actual flow rate measured at surface (BFPD)

$P_{av}$=Average reservoir static pressure (psi)

$P_{wf}$=Actual bottomhole flowing pressure (psi); and wherein $Q_a$ and $P_{wf}$ are one of received from said external source and retrieved from said memory storage, and $P_{av}$ is one of generated based on data inputted from said external source and retrieved from said memory storage device.

41. The computer-readable medium according to claim 38, further comprising the step of receiving data on an average reservoir static pressure $P_{av}$, an actual bottom hole flowing pressure $P_{wf}$, and on a bubble point pressure $P_b$, and when said actual bottom hole flowing pressure $P_{wf}$ is less than a bubble point pressure $P_b$, and said bubble point pressure $P_b$ is less than said average reservoir static pressure $P_{av}$, then said optimum, productivity index $Pi_0$ is automatically generated using a Darcy Law modified equation defined according to the following equation:

$$PI_o = \frac{Q_0}{(P_{av} - P_{wf})} = \frac{7.08Kh}{\mu B_0 \mathrm{In}(Re/Rw - (0.75 + S))}$$

wherein:

K=Formation permeability in Darcies

H=Formation thickness, in ft.

$P_{av}$=Average reservoir pressure, in psi $P_{wf}$=Bottom hole flowing pressure, in psi $\mu$=Viscosity, in Cp $R_e$=Outer radius of well influence, ft.

$R_w$=Wellbore radius, ft.

$Q_0$=Flow rate (BFPD), at sand face and with no skin (S=0)

$B_0$=Formation volume factor or volumetric factor

Wherein K, H, $P_{av}$, $P_{wf}$, $\mu$, $R_e$, $R_w$, $B_0$, S, and $Q_0$, are one of received from said external source and retrieved from said memory storage.

42. The computer-readable medium according to claim 37, wherein when the well was producing before an operation is performed, said well productivity index ration $PI_R$ is automatically generated as an increment to a productivity index obtained with said operation, as defined by the following expression:

$$PI_R = (PI_A - PI_{BO})/PI_{BO}$$

wherein said productivity index $PI_{BO}$ is automatically generated for conditions that exist before a well operation, according to the following expression:

$$PI_{BO} = \frac{Q_a}{(P_{av} - P_{wf})}.$$

43. A data processing system comprising:

a memory comprising a spreadsheet program that, generates a well construction time ratio $WCT_R$ for a well, said $WCT_R$ reflecting the execution performance of the well; generates a well productivity index ration $PI_R$ for the well, said $PI_R$ reflecting the production result of the well, and that automatically generates a well optimization index WOI for the well based on a weighted average between said well construction time ration and said well productivity index ration to determine performance of the well; and a processor that runs the program.

44. The system according to claim 43, wherein said well optimization index WOI generating step comprises the step of automatically comparing a weighted average of an operation execution performance as defined by said well construction time ratio $WCT_R$, to production result performance as defined by said well productivity index ratio $PI_R$, according to the following expression:

$$WOI = \frac{PI_R N + WCT_R}{N + 1}$$

Wherein N is a weighting constant that represents a recovery of cost.

45. The system according to claim 44, wherein N is estimated based on historical data of cost recovery of a well operation.

46. The system according to claim 45, wherein said WOI comparing step comprises the step of inputting said weighting constant N from one of an external source and a memory storage device.

47. The system according to claim 46, wherein said well optimization index WOI varies from 1.0 in a best case to zero in a worst case.

48. The system according to claim 47, wherein said well construction time ration $WCT_R$ generating step comprises the step of automatically comparing a well construction theoretical limit $WCT_L$, defined as a theoretical minimum rig time to execute a well operation, in days, to an actual well construction time $WCT_L$, in days, in accordance with the following expression:

$$WCT_R = \frac{WCT_L}{WCT_A}.$$

49. The system according to claim 48, wherein said well construction time ratio $WCT_R$ varies from 1.0 in a best case where intervention time equals said predetermined technical limit $WCT_L$, to zero in a worst case, wherein intervention would not be completed.

50. The system according to claim 47, wherein said well productivity index ratio $PI_R$ generating step comprises the step of automatically comparing an optimum productivity index $PI_O$, in BFPD/psi, to an actual productivity index $PI_A$, in BFPD/psi, in accordance with the following expression:

$$PI_R = PI_A / PI_O.$$

51. The system according to claim 50, wherein said well productivity index ratio $PI_R$ varies from 1.0 in a best case where productivity of the well is at an optimum, and zero in a worst case, where the well has no production.

52. A method in a data-processing system for determining performance of a well, the data processing system having a spreadsheet program which performs a method comprising the steps of:

receiving a name of the well from an external source;

retrieving first data about the well from a memory storage device based on said name of the well;

receiving second data about the well from said external source;

generating a well construction time ratio $WCT_R$ for the well using said data and said second data;

generating a well productivity index ratio $PI_R$ for the well using said first data and said second data; and automatically generating a well optimization index WOI for the well based on a weighted average between said well construction time ratio and said well productivity index ratio.

53. A method in a data-processing system for determining performance of a well, the data processing system having a spreadsheet program which performs a method comprising the steps of:

receiving a name of the well from an external source;

receiving a request to generate a well construction time ratio $WCT_R$ for the well;

retrieving well construction time technical limit $WCT_L$ data on the well from a memory storage device based on said name of the well;

receiving actual well construction time data $WCT_A$ on the well from said external source;

automatically generating said well construction time ratio $WCT_R$ based on a relation between said well construction time technical limit $WCT_L$ and said actual well construction time $WCT_A$;

receiving a request to generate a well productivity index ratio $PI_R$ for the well;

receiving actual productivity data on the well;

generating an actual productivity index $PI_A$ based on said actual productivity data;

generating an optimum productivity index $PI_O$ based on said actual productivity data and stored productivity data based on said name of the well, retrieved from said memory storage device;

automatically generating said well productivity index ratio $PI_R$ based on a relation between said actual productivity index $PI_A$ and said optimum productivity index $PI_O$; and automatically generating a well optimization index WOI for the well based on a weighted average between said well construction time ratio $WCT_R$ and said well productivity index ratio $PI_R$.

54. A method of determining performance of a well, the method comprising the steps of:

generating performance data from measurements taken during operation of the well;

generating a well construction time ratio $WCT_R$ fro the well using said performance data;

generating a well productivity index ratio $PI_R$ for the well using said performance data; and automatically generating a well optimization index WOI for the well based on a weighted average between said well construction time ratio and said well productivity index ratio.

55. The method according to claim 54, wherein said well optimization index WOI generating step comprises the step of automatically comparing a weighted average of an operation execution performance as defined by said well construction time ratio $WCT_R$, to production result performance as defined by said well productivity index ratio $PI_R$, according to the following expression:

$$WOI = \frac{PI_R N + WCT_R}{N + 1}$$

Wherein N is a weighting constant which represents a recovery of cost.

56. The method according to claim 55, wherein the method is performed by a data processing system.

* * * * *